United States Patent [19]

Athalye

[11] Patent Number: 4,901,391

[45] Date of Patent: Feb. 20, 1990

[54] HEARING AID CANAL CLEANING APPARATUS

[76] Inventor: Ravindra G. Athalye, 22700 Lake Shore Forest #113, El Toro, Calif. 92630

[21] Appl. No.: 250,528

[22] Filed: Sep. 29, 1988

[51] Int. Cl.[4] ..... A47L 25/00

[52] U.S. Cl. ..... 15/3; 15/3.53; 15/23; 381/124; 408/202; 408/241 S

[58] Field of Search ..... 15/3, 3.53, 23, 24; 173/163; 408/202, 207, 241 S; 310/50; 381/124

[56] References Cited

U.S. PATENT DOCUMENTS 3,935,909 2/1976 Mabuchi et al. ..... 15/23 X 4,647,260 3/1987 O'Hara ..... 408/202

4,802,798 2/1989 Adamson ..... 408/202

*Primary Examiner*—Edward L. Roberts

*Attorney, Agent, or Firm*—Jack C. Munro

[57] ABSTRACT

A motor operated, hand held apparatus for dislodging and removing of accumulated earwax within the canal of a hearing aid. This apparatus utilizes a narrow elongated tool which has a spiral exterior surface which is to be inserted within the canal of the hearing aid and operated at high speed to remove and move the earwax exteriorly of the canal. Associated with this tool is a cover which is to be movable to different positions to limit the amount of extension of the tool to within the canal to thereby eliminate any potential damage to the electronic mechanism of the hearing aid.

5 Claims, 1 Drawing Sheet

HEARING AID CANAL CLEANING APPARATUS

BACKGROUND OF THE INVENTION

The field of this invention relates to hearing aids and more particularly to an apparatus which facilitates cleaning of the canal formed within the hearing aid.

The development of the electronic hearing aid was the biggest advance ever made in helping people that are hard of hearing. Hearing aids are now in widespread use by millions of people. All hearing aids are fundamentally simple acoustic amplifying systems and consist of four basic parts: a microphone to pick up the sound and convert it to a small electrical signal; an amplifier to increase the size of the electrical signal; an earphone (receiver) to turn the electrical signal into an acoustic signal which is then fed into the ear through an ear mold; and, a source of power for the amplifier which is usually a battery. The ear mold is essential for fitting the hearing aid to the user. The ear mold is usually made of plastic and is commonly molded from an impression taken of the user's ear so that it is custom fitted.

For purposes of appearance, it is common that the ear molds be worn within the ear making the hearing aid not readily observable. Not only is the hearing aid custom designed for the physical structure of the particular individual's ear, but also, hearing aids are now being custom designed for the tones which that particular individual has trouble hearing. Each hearing aid has a canal (a very thin, elongated hole) that connects the electronics of the hearing aid to the ear canal of the user. The canal within the hearing aid is designed to be of a specific length for that particular individual depending upon what particular tone level or levels that the user has difficulty hearing. As the hearing aid is worn, it is common that this tiny canal collects earwax from the user's ear. It does not take much earwax for this hearing aid to become inoperative.

Because the diameter of this canal is so small, previous to the present invention, it has been difficult for the user to use a tool to clean this canal. The inner end of this canal terminates in a flexible vibrating diaphragm. If this diaphragm is contacted by a tool, it can be destroyed.

Hearing aid manufacturers have in the past suggested using a "scoop" to clean this canal. However, this scoop is ineffective due to the following reasons: (1) The scoop when entering the canal compacts the wax inward therefore is effective in only scraping the wax from the wall of the canal. (2) many excursions have to be made to effectively scrap all portions of the wall of the canal. (3) This cleaning process is tedious besides being ineffective. Many of the users are elderly people who do this cleaning infrequently due to its cumbersome nature. (4) The length of the canal is not within the view as the scoop moves into the canal. There is always a possibility to damage the hearing aid speaker diaphragm by deep passage of the scoop into the canal.

Therefore, in the past in order to affect proper cleaning of this canal, it was necessary for the individual to take the hearing aid back to the manufacturer where the manufacturer physically open up the hearing aid and cleans this canal. However, this taking of the hearing aid back to the manufacturer is time consuming and expensive. Plus, there is a certain period of time that the user is without the use of the hearing aid.

Quite frequently, a single user may wear a hearing aid in both the right ear and the left ear. This designing of any tool to clean the hearing aid is complicated because the length of the canal of the hearing aid in the right ear may be of a different length than the one in the left ear. Therefore, to use the exact same tool to clean the hearing aid of both the right ear and the left ear may result in permanent damage to either (or both) hearing aids.

SUMMARY OF THE INVENTION

The objective of the present invention is to construct a tool which is to be usable to facilitate the cleaning of earwax from the canal of a hearing aid and, if the cleaning is performed properly, it will absolutely prevent the occurrence of any damage to the hearing aid.

Another objective of the present invention is to construct a tool which can be operated by even the most unskilled individual and which can be manufactured and sold at an inexpensive price.

The hearing aid canal cleaning apparatus of the present invention is constructed of a hand holdable sheet material housing within which is located a battery and a motor. Switch means is mounted on the exterior surface of the housing that when moved causes operation of the motor. The motor clauses rotation of a narrow, elongated tool which protrudes from the housing. This tool protrudes through a threaded sleeve. This tool has a helical exterior configuration. A cover is mounted on the threaded sleeve which has an interior chamber through which the tool is conducted. The cover can be adjustably mounted onto the threaded sleeve from a position completely encasing of the tool to a position permitting the tip of the tool to extend some distance from the cover. The threaded sleeve is to include indicia with the inner end of the cover to be aligned with the indicia to have the tip of the tool extend a predetermined amount from the outer end of the cover. The position of this indicia is predetermined so as to limit the extension of the tool from the cover to correspond with the length of the canal of the hearing aid for which the tool is to be used.

DETAILED DESCRIPTION OF THE SHOWN EMBODIMENT

Figure 1:
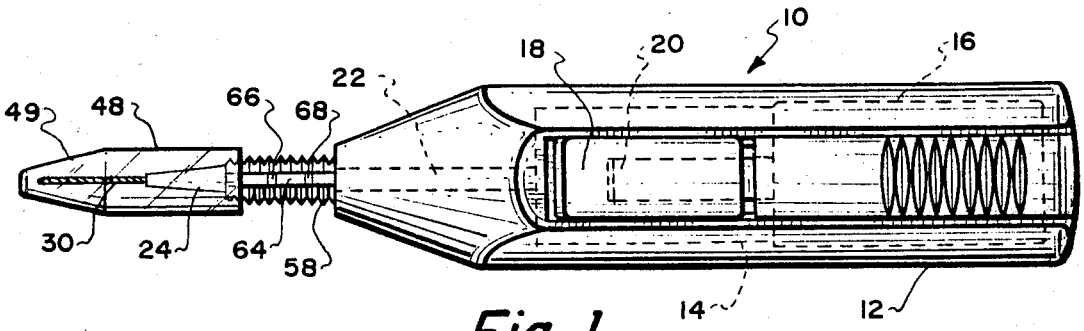
FIG. 1 is a top side elevational view of the hearing aid canal cleaning apparatus of the present invention showing the cover mounted in a position to completely encase the rotatable tool of the apparatus of this invention.

Referring particularly to the drawing there is shown the hearing aid canal cleaning apparatus 10 of this invention which has a sheet material plastic housing 12. This housing 12 has an interior compartment within which is mounted a motor 14 which is to be electrically driven by a battery 16. The exterior surface of the housing 12 is a deflectable plastic strip 18 which is to be movable against a spring member 20. Pressing of the plastic strip 18 inwardly toward the housing 12 against the action of the spring member 20 results in connecting of the motor 14 to the battery 16 which will result in rapid rotation of a motor shaft 22.

Snugly mounted on the motor shaft 22 is a plastic connector 24 that has a through opening 26. Within the forward end of this through opening 26 is mounted a plug 28. Embedded within this plug 28 is the inner end of a wire tool 30. This wire tool 30 has a spiral exterior surface resembling a screw thread configuration. The spirals are arranged to correspond with the direction of the rotation of the shaft 22 so that the spirals will tend to pick up earwax 32 and move such in a direction toward the connector 24. The tip 34 of the tool 30 is to be inserted within a canal 36 of a hearing aid ear mold 38. It is within this canal 36 that the earwax 32 has accumulated.

It is very important that when the apparatus 10 is used and tip 34 is inserted into the canal 36, that the tip 34 does not come into contact with the diaphragm 40 of the hearing aid 42. This diaphragm 42 is to be electrically vibrated by sound which is amplified to certain preestablished frequency ranges by means of an electronic chip 44 which is electrically driven by a replaceable battery 46. However, the operation in construction of the hearing aid 42 is deemed to be conventional and forms no specific part of this invention.

In order to insure that the tip 34 does not contact the diaphragm 40, there is utilized structure, that when used properly, will prevent this from occurring. This structure has to do with a cover 48 which has a series of interior threads 50 and an interior chamber 52. The outer end of the interior chamber connects with the ambient by means of a hole 54. The cover 48 has an inner edge 56. Fixedly attached to the housing 12 is a threaded sleeve 58. This threaded sleeve 58 has an interior through opening 60. It is through this opening 60 that the motor shaft 22 and the connector 24 is conducted.

Figure 2:
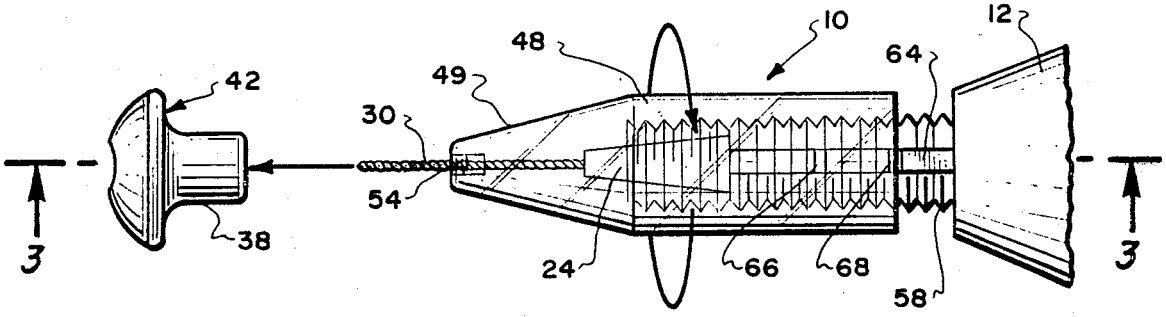
FIG. 2 is a view of just the tool portion of the hearing aid canal cleaning apparatus of this invention showing the cover being moved to a position where the tip of the tool extends from the cover and insertion of the tip of the tool is depicted within the canal of the hearing aid.

The interior threads 50 threadably engage with the threaded sleeve 58. The cover 48 is to be movable from a position shown in FIG. 1, which completely encases the tool 30, to a position in which the tool 30 protrudes through the hole 54 with the tip 34 being spaced some distance from the outer end of the cover 48. This position is clearly shown in FIGS. 2 and 3 of the drawing. The amount of extension of the tip 34 can be readily varied by threading of the cover 48 relative to the threaded sleeve 58. The threaded sleeve 58 includes a longitudinal flattened section 62. Adhesively secured on the flattened section 62 is a paper or plastic strip 64. Inscribed on the strip 64 is at least one line 66 and possibly a second line 68. The reason for the lines 66 and 68 will now be explained.

Figure 3:
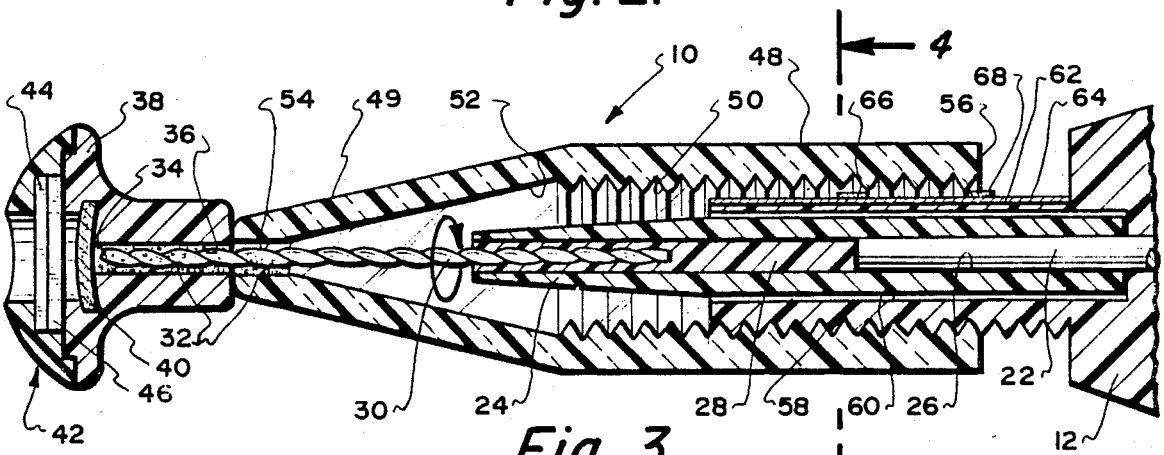
FIG. 3 is a cross-sectional view taken along line 3—3 of FIG. 2 but showing the tip of the tool fully inserted within the canal of a hearing aid.
Figure 4:
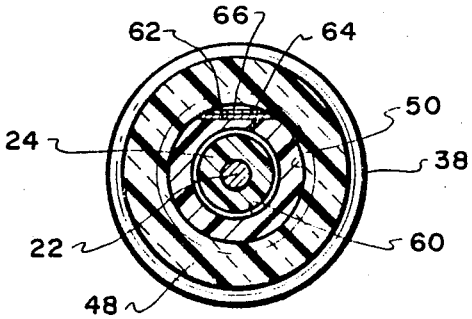
FIG. 4 is a cross-sectional view taken along line 4—4 of FIG. 3.

Let it be assumed that the user only has a hearing aid 42 in the right ear. The user determines the length of the canal 36 by inserting the tip 34 of the tool 30 into the canal 36 until the tip 34 just contacts the diaphragm 40. The tool 30 is not operating at this time. The forward end of the cover 48 is formed into a chamber 49. The narrowing of cover 48 by chamfer 49 make it easier for the user to observe the locating of tip 34 into canal 36. The cover 48 is then positioned to abut against the ear mold 38 as shown in FIG. 3. The cover 48 is turned on the threads 58 another half of turn so that the tip 34 will just move a slight distance away from the diaphragm 40. The user then proceeds to inscribe the line 66. It is preferable that this line 66 be made in a particular color such as red. Possibly a red dot or other similar type of indicia is to be placed on the ear mold 38 in some obscure area. This now tells the user that when cleaning the ear mold 38 for the right ear that the cover 48 is to be positioned so that the edge 56 lines up with the line 66. Therefore, when the strip 18 is depressed and the tool 30 rotated and it is inserted within the canal 36, that there is no fear of the tip 34 contacting the diaphragm 40 even during full insertion of the tool 30.

If the user has a hearing aid 42 for the left ear, the same procedure is repeated for this particular ear mold 38. This will normally result in the different inscribed line 68. This line 68 is to be made of a different color, such as blue, with a corresponding blue dot being placed on the ear mold 38. Hopefully, by facilitating the coordination of the color of the lines 66 and 68 to the color of the dots on the ear molds 38 that there will be eliminated any possibility of confusion when using of the apparatus 10 of this invention in cleaning the canal 36 of both the right ear mold 38 and the left ear mold 38.

After the tool 30 has been used to clean a canal 36, the earwax that is collected on the tool 30, as well as within the hole 54, and the interior chamber 52, is to be removed by wiping or other commonly used cleaning technique.

What is claimed is:

1. A hearing aid canal cleaning apparatus comprising:

a housing having an exterior threaded sleeve;

a motor shaft protruding from said housing through said threaded sleeve, said motor shaft connected to a motor, said motor to cause rotation of said motor shaft relative to said housing;

a tool attached to said motor shaft and to be rotatable therewith, said tool being narrow in width and elongated in length, said tool terminating in a tip at its free outer end; and a cover threadably mounted on said threaded sleeve, said cover having an interior chamber, said tool being located within said interior chamber, said tip of said tool being capable of protruding from said threaded sleeve, said cover being movably mounted on said threaded sleeve from a first position totally locating said tool within said interior chamber to a second position resulting in protrusion of said tip of said tool a predetermined distance from said threaded sleeve, whereby said tip is to be located within the canal of a hearing aid and upon rotation of said tool cause removal of accumulated earwax within the canal.

2. The cleaning apparatus as defined in claim 1 wherein:

said tool having an exterior wall surface of a configuration tending to dislodge the accumulated earwax from the wall of the canal and cause moving of the earwax exteriorly of the canal.

3. The hearing aid canal cleaning apparatus as defined in claim 2 wherein:

said configuration being in the shape of a spiral.

4. The hearing aid canal cleaning apparatus as defined in claim 3 wherein:

the greatest width of said tool being substantially less than the diameter of said canal.

5. The hearing aid canal cleaning apparatus as defined in claim 1 wherein:

indicia means mounted on said threaded sleeve, said cover having an inner edge, said inner edge to be movable and in alignment with said indicia means to thereby establish the amount of protrusion of said tip of said tool from said cover.

* * * * *